US009955789B2

(12) United States Patent
Herring et al.

(10) Patent No.: US 9,955,789 B2
(45) Date of Patent: May 1, 2018

(54) DESK TREADMILL ASSEMBLY WITH CHAIR PLATFORM

(71) Applicant: Next Technologies, Inc., Georgetown, TX (US)

(72) Inventors: Jason Brian Herring, Georgetown, TX (US); Shane Michael Gilbreath, Georgetown, TX (US)

( * ) Notice: Subject to any disclaimer, the term of this patent is extended or adjusted under 35 U.S.C. 154(b) by 154 days.

(21) Appl. No.: 14/731,206

(22) Filed: Jun. 4, 2015

(65) Prior Publication Data

US 2015/0351553 A1 Dec. 10, 2015

Related U.S. Application Data

(60) Provisional application No. 62/007,549, filed on Jun. 4, 2014.

(51) Int. Cl.

| | |
|---|---|
| ***A63B 22/02*** | (2006.01) |
| ***A47C 7/62*** | (2006.01) |
| ***A47C 7/00*** | (2006.01) |
| ***A47B 91/00*** | (2006.01) |
| ***A47B 97/00*** | (2006.01) |

(Continued)

(52) U.S. Cl.

CPC ..... *A47C 7/62* (2013.01); *A47B 91/005* (2013.01); *A47B 97/00* (2013.01); *A47C 7/002* (2013.01); *A47C 7/006* (2013.01); *A47B 2220/06* (2013.01); *A63B 22/02* (2013.01); *A63B 22/0242* (2013.01); *A63B 2071/009* (2013.01); *A63B 2071/0081* (2013.01); *A63B 2071/0683* (2013.01); *A63B 2208/0233* (2013.01); *A63B 2210/06* (2013.01)

(58) Field of Classification Search

CPC ..... A47C 7/62; A47C 7/002; A47C 7/006; A47B 97/00; A47B 91/005; A47B 2220/06; F16M 11/42; F16M 11/04; A63B 2210/00; A63B 22/0242; A63B 2071/0081; A63B 2071/009; A63B 2071/0683; A63B 2208/0233; A63B 22/02–22/268; G08C 2201/93

USPC ..... 482/51–54, 904

See application file for complete search history.

(56) References Cited

U.S. PATENT DOCUMENTS 5,687,984 A * 11/1997 Samuel ..... B62B 3/008 280/42

7,614,991 B2 11/2009 Fox (Continued)

*Primary Examiner* — Stephen R Crow

*Assistant Examiner* — Garrett Atkinson

(74) *Attorney, Agent, or Firm* — Kevin Keener; Kevin and Associates, P.C.

(57) ABSTRACT

Exercise treadmill chair platform that resides horizontally over a treadmill when it is not in use to stabilize an office chair while it resides beneath the desk. The platform has a top and bottom flat plate, aligned, square or rectangular shaped, and of a low profile, that slides over the treadmill to cover the belt when the treadmill is not in use, thus enabling the user to safely sit at the desk without having to store away the treadmill. The platform may further comprise a right and left side wall; and, four corner wheels to assist the user in moving the platform, and two bumpers to protect the wheels from entanglements. The top flat plate further comprises oval shaped grooves arranged in a circle, designed to house the wheels of a variety of types of swivel chairs in order to keep the chair from rolling off of the platform.

20 Claims, 6 Drawing Sheets

(51) Int. Cl.
*A63B 71/00* (2006.01)
*A63B 71/06* (2006.01)

(56) References Cited

U.S. PATENT DOCUMENTS

| | | | | |
|---|---|---|---|---|
| 7,780,578 | B2 * | 8/2010 | Packham | A63B 22/02 482/4 |
| 8,602,443 | B2 * | 12/2013 | Moore | B62B 3/002 280/651 |
| 2006/0247107 | A1 | 11/2006 | Carter | |
| 2006/0247109 | A1 | 11/2006 | Powell | |
| 2012/0088633 | A1 | 4/2012 | Crafton | |
| 2012/0174833 | A1 | 7/2012 | Early | |

* cited by examiner

DESK TREADMILL ASSEMBLY WITH CHAIR PLATFORM

PRIORITY CLAIM

This utility patent application claims priority to U.S. Provisional Application 62/007,549 filed on Jun. 4, 2014. The entire disclosure of the aforementioned patent application is incorporated herein by reference.

FIELD OF THE DISCLOSURE

The present disclosure relates generally to office equipment, and more particularly to a platform, and/or a desk assembly, for use with an exercise treadmill and a swivel office chair resting upon a platform that is covering the treadmill when the treadmill belt is not rotating.

BACKGROUND OF THE DISCLOSURE

Office desks for use with treadmills are well known in the art. Often the desk is height adjustable to allow the user to raise the desk to a standing position while in use with the treadmill, and then to lower the desk to a sitting position after removing and storing the treadmill.

For example, US Patent Application 20120174833 by Early teaches a treadmill for use with a desk that requires the user to sit in a high draftsman chair or remain standing after the treadmill is removed.

U.S. Pat. No. 7,614,991 by Fox discloses a treadmill with side bars wherein the treadmill is encircled on three sides by a cubicle desk. It would be very difficult for the treadmill to be moved backwards away from the desk in order to replace it with an office desk chair.

U.S. Pat. No. 7,780,578 by Packham discloses a treadmill that folds up under a height adjustable desk when not in use. Unfortunately, the folded treadmill reduces the amount of leg space that the user is permitted when they are sitting beneath the desk.

US Patent Application 20060247107 by Powell discloses a treadmill beneath a desk and a chair affixed to bars that rotate the chair over the treadmill when the treadmill is not in use. Unfortunately, the user is only able to use the chair that is affixed to the bars, versus their own preferred chair, and the chair requires extra space when rotated outside of the desk while the treadmill is in use.

The prior art also discloses a variety of small workstations able to hold a computer that comprises a base slid under a treadmill, such as US Patent Application 20120088633 by Crafton. Unfortunately, the workstations are not full size office desks with flat desktop surfaces that can hold all of the user's computing equipment, files, personal items, etc. The user is therefore required to use the workstations only when exercising, and then switch back to their normal desk when they are sitting or standing and not exercising, which may require moving their computer.

If the user wanted to the save time and energy required in moving and storing the treadmill, they could merely place their office chair astride the treadmill and lower the desk. Unfortunately, this is not a particularly safe option in the event that the treadmill and/or chair starts rolling. Additionally, many office chair legs are too wide to be placed on a level surface on the treadmill so as to not have rocking of the chair. And there is the potential for the chair damaging the treadmill belt by leaving permanent indentations in the rubber that would prevent the belt from rotating smoothly.

The prior art does not teach a safe method of using the desk with the chair sitting astride the treadmill. Therefore, there is a need within the office furniture industry for a platform and/or desk assembly suitable for use with an exercise treadmill that permits that safe use of a desk chair when the treadmill is not in use, and that does not require having to move or store the treadmill. There is also a need for a "universal" platform that is of suitable dimensions for use with a wide variety of exercise treadmills, and with a wide variety of office desk chair types and sizes, whether they are wheeled chairs or not, four legged, six legged, etc.

SUMMARY OF THE DISCLOSURE

Chair Platforms and Desk Treadmill Assemblies

Various embodiments of the present disclosure comprise an exercise treadmill chair platform to support and stabilize a standard office desk chair, such as a swivel-wheeled office chair while a user is sitting at an office desk. The platform resides over an exercise treadmill when the treadmill is not in use. Therefore, when using a chair platform of the various embodiments disclosed herein, the treadmill does not have to be moved or stored when not in use in order for the user to have access to their full size desktop, nor are they required to move their computer to another workstation when exercising.

Various embodiments may further comprise one or more desk treadmill assemblies comprising the chair platform with one or more of: an office desk, an office desk chair, and/or an exercise treadmill, wherein the desk is: 1) height adjustable; and/or, 2) is a standard desk without the ability to move up and down, but still tall enough to accommodate the height of the treadmill. The desk may be height adjustable to accommodate the user while exercising in a standing position, such as walking, and then lowering the desk for sitting on an office chair that is residing upon the chair platform that temporarily covers the treadmill belt. The user is thus not required to move the treadmill in order to sit at their desk, or to lift the chair or platform. They merely roll the platform with the chair over the treadmill when they wish to sit at their desk, and roll the platform with the chair off of the treadmill when they wish to walk and work.

Alternatively, the desk may be a standard desk (not height adjustable) and fixed at a height that accommodates its use both with the treadmill and with the chair on a platform astride the treadmill (i.e. the desktop is a few inches higher than the standard desktop). This embodiment may further comprise a height adjustable computer monitor and keyboard residing on the desktop. When the user is exercising on the treadmill, the monitor and keyboard are raised; and then they are lowered when the user slides the platform over the treadmill and sits in the chair.

It is noted that the various embodiments disclosed herein can be used with a wide variety of types of exercise treadmills. In the various embodiments, the treadmill may comprise only the bottom rotating belt and structure or frame, while lacking a waist high side or front assembly housing the user controls. The treadmill may also lack safety side bars so that the treadmill may easily reside under an office desk. For example, the user mechanism for controlling the operation of the treadmill may co-reside on the desktop with the mechanism for raising or lowering the height adjustable desk, and/or it may be located on the rear or side of the treadmill bottom outer structure that houses the treadmill belt, and/or it may be remotely controlled (e.g. via a wireless control unit).

The chair platform of the various embodiments of the present disclosure in an embodiment comprise a top flat plate and a size matched bottom plate of the same width and length as the top flat plate. Both plates are either square or rectangular shaped and are of sufficient width to fit over the entire width of a standard indoor treadmill (right side-to-left side, FIG. 1). They are also of sufficient width and length to fit the legs of a standard swivel office chair without the leg ends (e.g. chair wheels) residing too near the edge of the platform. The platform is also of sufficient height to easily slide over the top of a standard indoor exercise treadmill and rest above the treadmill without touching it.

The chair platform of another embodiment may comprise one plate in lieu of the top and bottom plate, and with the mechanical strength to support the weight of a chair and user, while comprising all of the structural features of the top and bottom flat plate embodiment. References to the top plate disclosed herein may be interpreted to refer to the top surface of the one plate embodiment.

Furthermore, the top and bottom flat plate each comprise four aligned corners, an upper side and underside, and two opposing side edges align-able on the outside of the exercise treadmill right and left sides. The top plate rests directly upon the bottom plate (i.e. the underside of the top plate is touching the upper side of the bottom plate).

The platform may further comprise two opposing side walls that cover the right and left sides of the treadmill, as well as wheels of the platform. The two opposing side walls are affixed perpendicularly to the top and/or bottom plates opposing side edges (i.e. right and left side of platform) and extend vertically downward to the floor while not directly touching the floor. The two opposing side walls also comprise a vertical front edge and a vertical back edge. A corner, or junction, is created where an opposing side wall vertical edge is joined to a horizontal top and/or bottom plate. In an embodiment, the opposing side walls are fabricated with the top and/or bottom plate as one unit.

The platforms may further comprise bottom wheels to the user in rolling the platform over and off of the treadmill. Non-wheeled platforms are light enough in weight for the user to easily lift and lower the platform. Both wheeled and non-wheeled embodiments may further comprise handles, or other mechanisms, affixed to the top plate or outer surface of the opposing side walls to assist the user in grasping, lifting, and moving the platform.

In an embodiment, the treadmill desk assembly platform further comprises four wheels affixed to the underside of the bottom plate. A front and a back wheel are located near, and aligned with both opposing side walls interior surface. The wheels are also not viewable from outside of the platform two opposing sides walls.

The platforms may further comprise a bumper member covering the wheels to protect against objects getting caught in the wheels. In one exemplified embodiment, one bumper member each (i.e. two total for each platform) extends along the length of the right and left side of the platform, covering the front of the front wheel to the back of the back wheel, and on the inner side of the wheels (e.g. opposite of the side walls). In an embodiment, each bumper member extends from the platform opposing side wall front edge to the back edge and around the front and back wheel inner side.

Furthermore, the platforms may comprise grooves in the top flat plate of the platform that are shaped to fit the wheels of a variety of sizes of standard swivel office chairs. In one or more embodiments, office chairs suitable for use with the treadmill chair platform are swivel chairs with four to six wheels configured in a circle, one wheel each attached to a leg residing substantially parallel to the ground and extending from a chair central vertical axle to each wheel. The grooves are arranged in a circular pattern to match the arrangement of the wheels of the chair. The platform grooves may be of an elongated oval shape to accommodate wheels of different sizes (e.g. widths and lengths) and are of sufficient depth to prevent the wheels from easily dislodging from the grooves when the chair and/or platform are moved. The platform may further comprise a round shaped groove in the center of the circular pattern of grooves that fits the central vertical axle of the chair.

Desk Treadmill Assemblies

In an embodiment, the present disclosure comprises an exercise treadmill desk assembly comprising an office desk chair platform and an office desk, wherein the desk is a height adjustable comprising: a flat desktop, a plurality of height adjustable legs, and wherein a user is able to position an exercise treadmill beneath the desk for the user to use the desktop while walking and otherwise exercising on the treadmill.

In another embodiment, the assembly comprises an office desk chair platform and an office desk comprising a standard desk without the ability to move up and down, but still tall enough to accommodate the height of the treadmill (e.g. height adjustable computer monitor and keyboard).

For either desk treadmill assembly, the assembly may further comprise an exercise treadmill wherein the treadmill comprises a rectangular frame housing with a rigid outer surface and an inner surface comprising a rotatable belt and motors. In an embodiment, the treadmill does not comprise front or side rails or waist high controls. Instead operational controls for the treadmill are located on the desktop, such as co-located or incorporated into the controls for a height adjustable desk; or they are located on the side or backend of the treadmill rectangular frame.

In another embodiment, the assembly further comprises an office desk chair platform, an office desk, and an office desk chair that is configurable to rest in a fixed position astride the platform. The chair comprises a plurality of legs (e.g. four straight, six swivel, etc.) with a chair wheel affixed or not to the end of each leg. When the chair is wheeled, then the platform further comprises the top flat plate with a plurality of grooves, each groove configured to fit one of the chair wheels and able to prevent the chair from rolling off of the platform.

In an embodiment, the treadmill desk assembly chair is a swivel chair with a plurality of substantially horizontal legs configured in a circle and around a central vertical axel, and the groove for each chair wheel is oval shaped and of sufficient length and width to accommodate a variety of sizes of chair wheels and chair horizontal leg lengths. The top platform plate may further comprise a circular groove sufficient to house a bottom end of the chair central vertical axel.

BRIEF DESCRIPTION OF THE DRAWINGS

The above and other features, aspects, and advantages of the present disclosure will become better understood with regard to the following description, appended claims, and accompanying drawings where:

FIGS. 1-5 illustrate one embodiment of the platform for use with a chair comprising five wheels;

FIG. 1 illustrates one embodiment of the desk treadmill assembly comprising a height adjustable desk, an exercise treadmill beneath the desk, a five wheeled swivel office chair, and a platform atop the treadmill supporting the chair and locking it in position so that it may not roll off the platform;

FIG. 2 illustrates a top perspective view of one embodiment of the chair platform for use with a five wheeled, swivel office chair, comprising five oval grooves for the wheels and one center circular groove for the center axel;

FIG. 3 illustrates a bottom perspective view of one embodiment of the chair platform;

DETAILED DESCRIPTION OF EXEMPLARY EMBODIMENTS

The following description should not be used to limit the scope of the present disclosure. Other examples, features, aspects, embodiments, and advantages of the disclosure will become apparent to those skilled in the art from the following description, which includes by way of illustration, multiple various example embodiments. As will be realized, the disclosure is capable of other different and obvious aspects, all without departing from the inventive subject matter. Accordingly, the drawings and descriptions should be regarded as illustrative in nature and not restrictive. It should therefore be understood that the inventors contemplate a variety of embodiments that are not explicitly disclosed herein.

Desk Treadmill Assembly

Figure 1:
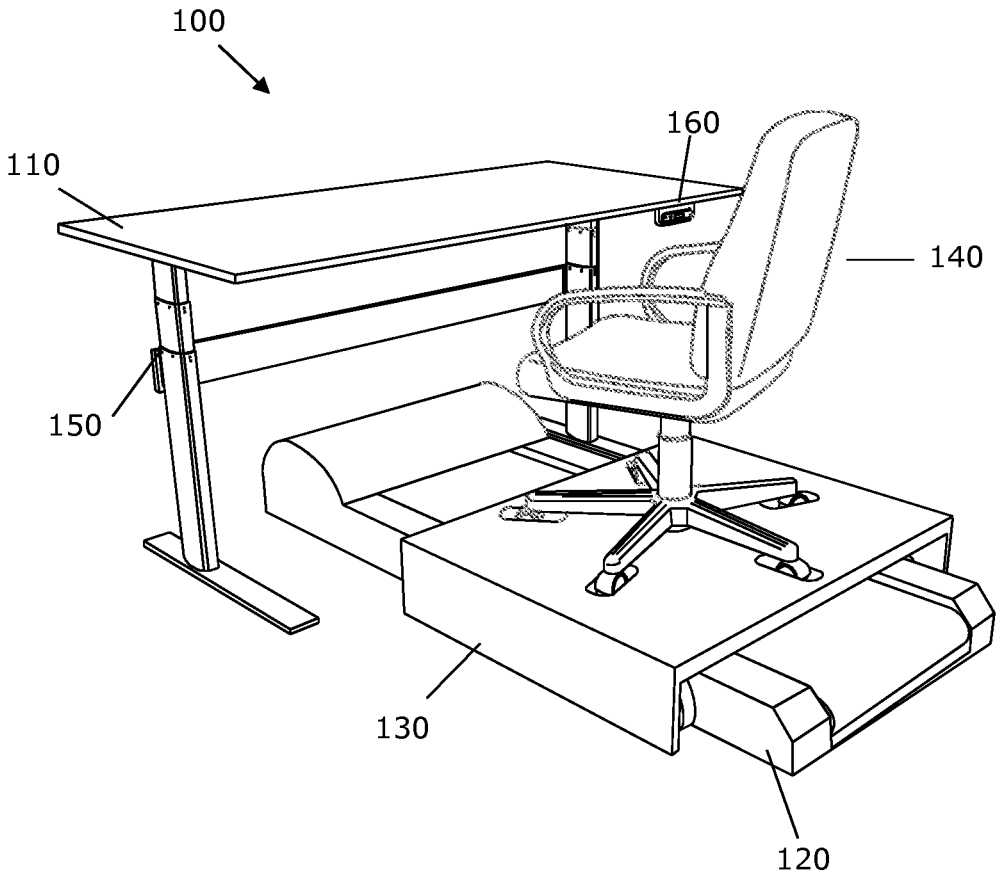

Height Adjustable Desk: FIG. 1 is an illustration of one embodiment of the desk treadmill assembly 100 comprising the chair platform 130 alone and/or with one or more of the components of: an office desk 110; and/or an exercise treadmill 120; and/or an office chair 140. In the exemplified embodiment, the desk 110 is a height adjustable using the movable legs 150. Height adjustable desks are well known in the art. In one embodiment, the height adjustable desk 110 may comprise a NextDesk™ height adjustable desk with dual 18-volt direct current motors housed within the desk legs 150 to raise and lower the desktop of desk 110 via a user switch 160 mounted on the desktop surface. In an embodiment, the treadmill controls are co-located with the switch 160.

Fixed Height Desk: Alternatively, the desk treadmill assembly 100 may also be used with an office desk that is fixed in height at a level sufficient to allow the user easy access to the desktop surface when the chair platform 130 is in place atop the treadmill 120. This desk height would accommodate the height of the treadmill 120 and the platform 130 (e.g. about 5-8 inches), and thus a fixed height desk 110 for use with the assembly 100 may have a desktop that is slightly higher than a standard office desk.

A fixed height desk 110 may further comprise a means to elevate a computer system monitor and keyboard residing on the desktop surface, such as a computer monitor and keyboard that is height adjustable but that does not require lifting the entire desktop as per a height adjustable desk. Therefore, with a fixed height desk 110 and a height adjustable computer monitor and keyboard, a user can still work while walking on the treadmill. Then when the treadmill is not in operation, the user lowers the computer monitor and keyboard, and slides the chair platform 130 back over the treadmill 120 to sit and work at the desk.

Exercise Treadmill

Exercise treadmills appropriate for use in the various embodiments of the present disclosure are well known in the art, and general comprise external components of a rectangular frame with a rotating belt that is motorized or otherwise electrically powered. In one embodiment, the treadmill 120 is designed for the user to walk at a pace of about 0.4 to 4 miles per hour for long periods of time (e.g. over an hour) without the treadmill motor overheating.

The treadmills for use in the desk assembly 100 may further lack a front assembly with operational controls, and/or safety side rails that are normally associated with an exercise treadmill. In lieu of the front assembly, the operational controls for the treadmill (e.g. power on/off, speed, incline, etc.) may be incorporated with the desk height adjustable controls 160 on or near the desktop, or otherwise mounted within easy reach of the user when the treadmill 120 is in operation; and/or the controls may be located on the side or back of the treadmill frame; and/or the treadmill may be operated with a remote control device.

Chair Platform

As illustrated in FIGS. 2-5, the various embodiments of the present disclosure further comprise chair platforms 130 that may be used with a wide variety of types of office chairs and exercise treadmills.

Figure 2:
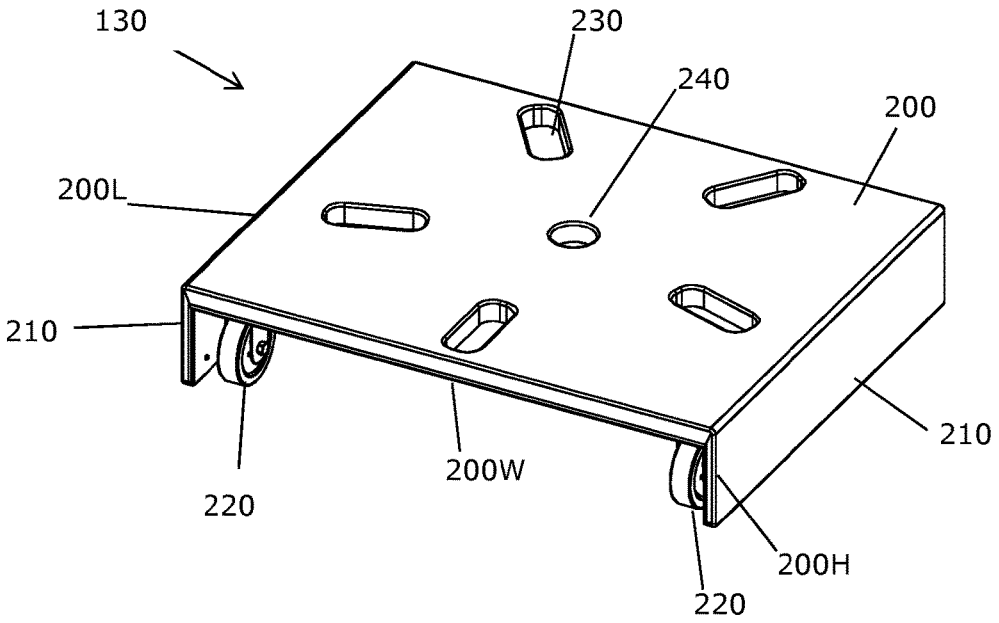
Figure 3:
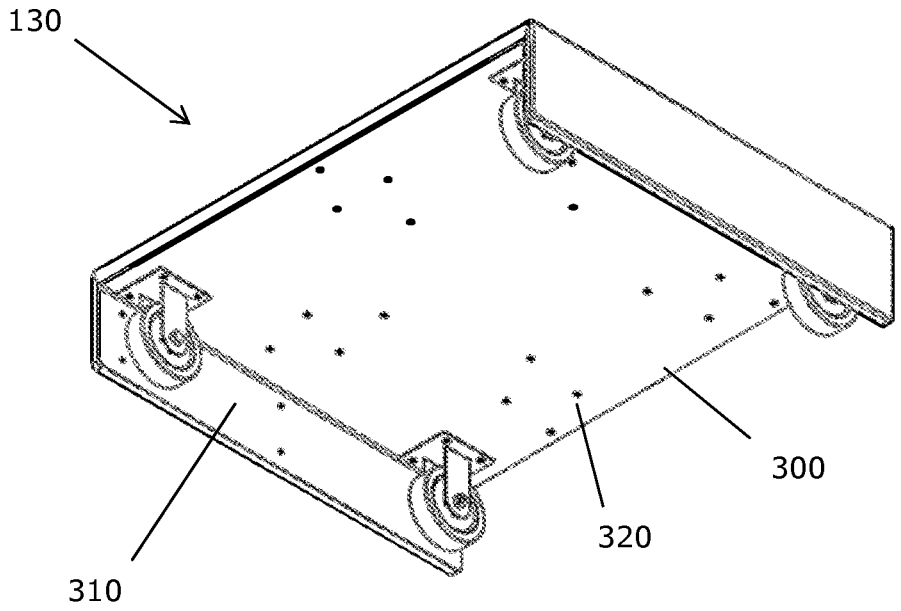

In one or more embodiments, the chair platform 130 comprises a top flat surface or plate 200 with two opposing side walls 210 (see FIG. 2—right and left side), and a bottom plate 300 with two opposing side walls 310 (see FIG. 3). The two opposing side walls 210, 310 are also perpendicular to the top and bottom flat plates, and extending vertically downward from the plates' opposing side edges (200L) to the floor. In alternative embodiments, the platform 130 may comprise no side walls, or have side walls on either the top plate 200 or bottom plate 300, but not both plates.

The top flat plate 200 and the bottom plate 300 are of a square or rectangular shape. The plates are also of sufficient width 200W to fit over the entire width of a standard exercise treadmill (side-to-side) so that the platform inside surface (i.e. underside of the bottom plate 300 and the inner side of the opposing side walls 210), and the platform wheels 220, reside near but not touching the outer side surface of the treadmill frame. The platform 130 is also of sufficient height 200H to easily slide over the top of a standard exercise treadmill—i.e. the height of the platform 130 slightly exceeds the height of the treadmill. The top flat plate 200 and bottom plate 300 are also of sufficient width 200W and length 200L to fit the legs of a standard office chair without the leg ends (e.g. chair wheels) residing too near the edge of the platform 130 for safety reasons.

In one embodiment illustrated in FIG. 2, by way of a non-limiting example, the side walls 210, 310 are about 7.5 inches in height (200H); and the top plate 200 and the bottom plate 300 are about 32 inches in length (200L measured front to back) and about 39 inches in width (200W measured side-to-side).

The top flat plate 200 and/or the opposing side walls 210 may also be made of a material that enhances the aesthetic appearance of the platform 130, such as a material that matches the material of the desktop. In one embodiment, the material of the platform top surface 200 is made from a bamboo, or a bamboo blend, or a composite thereof.

Figure 4A:
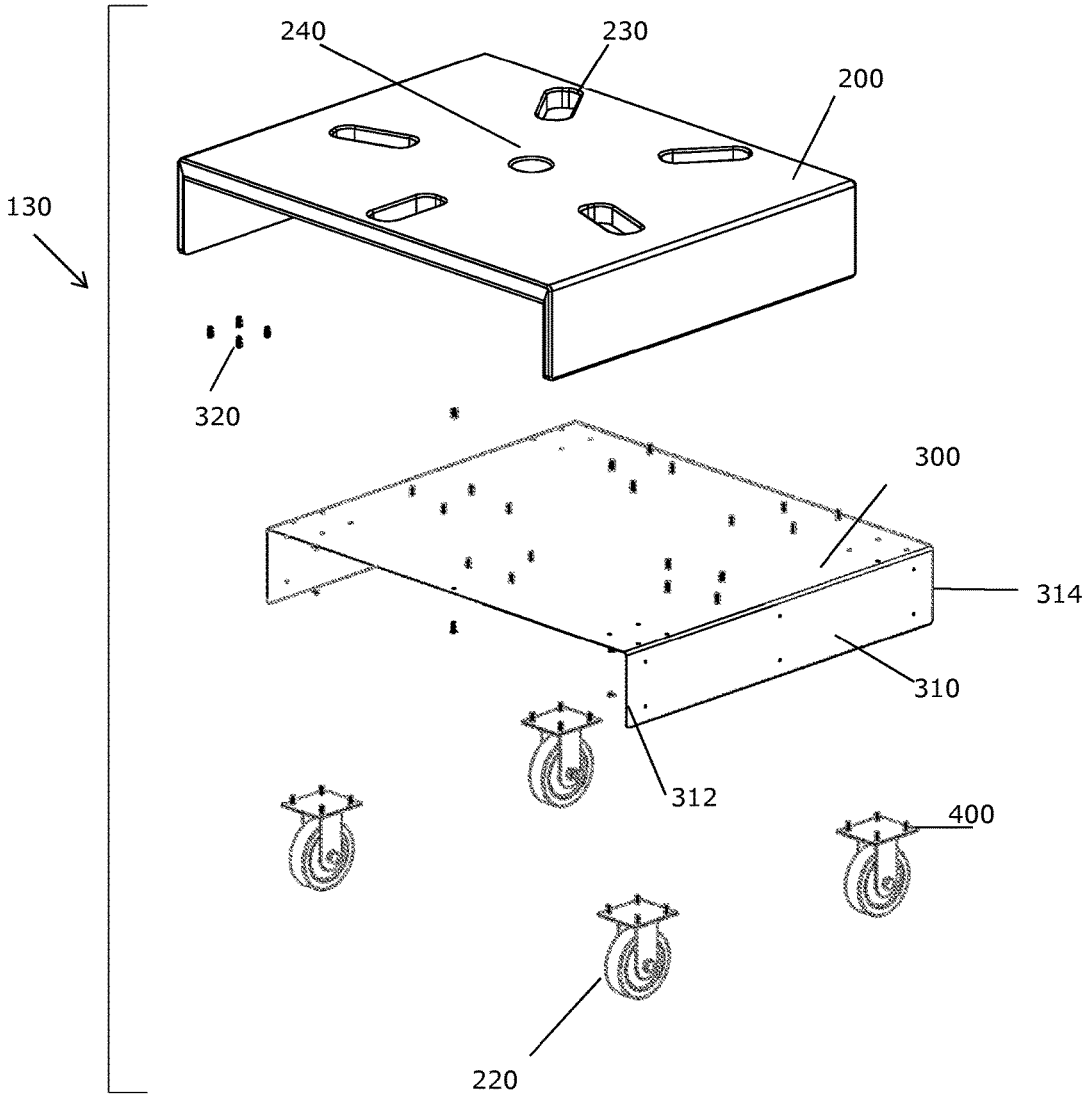
FIG. 4A illustrates an exploded top perspective view of the chair platform of FIGS. 2 and 3 showing the three main components of one embodiment of the chair platform: a top plate with two opposing side walls and wheel grooves; a bottom plate with two opposing side walls of substantially the same dimensions as the top plate; and, four wheels with a means of attachment to the corners of the bottom plate underside.
Figure 4B:
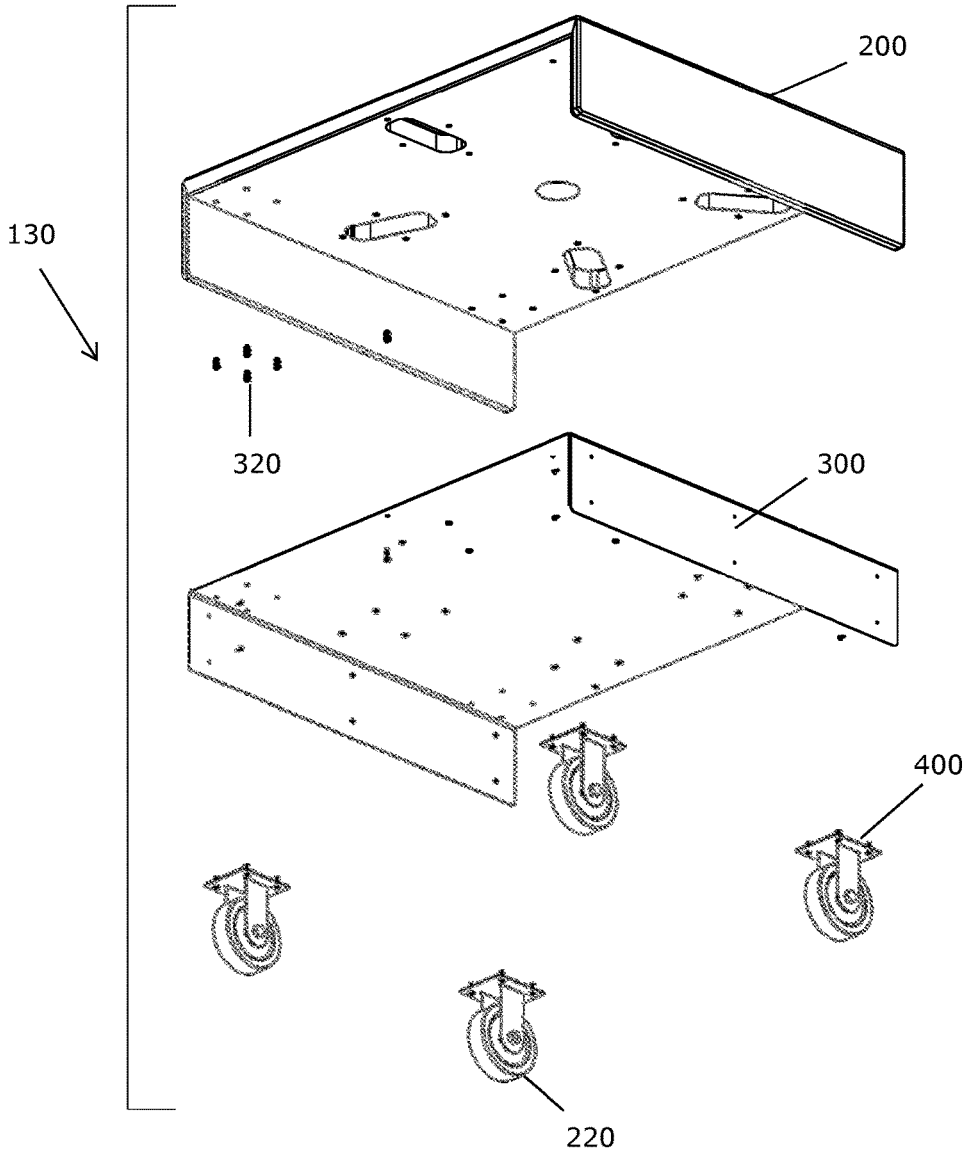
FIG. 4B illustrates an exploded bottom perspective view of the chair platform components in FIGS. 2 and 3; and, FIG. 5 illustrates a bottom perspective view of the chair platform with two bumper members covering the platform wheels.
Figure 5:
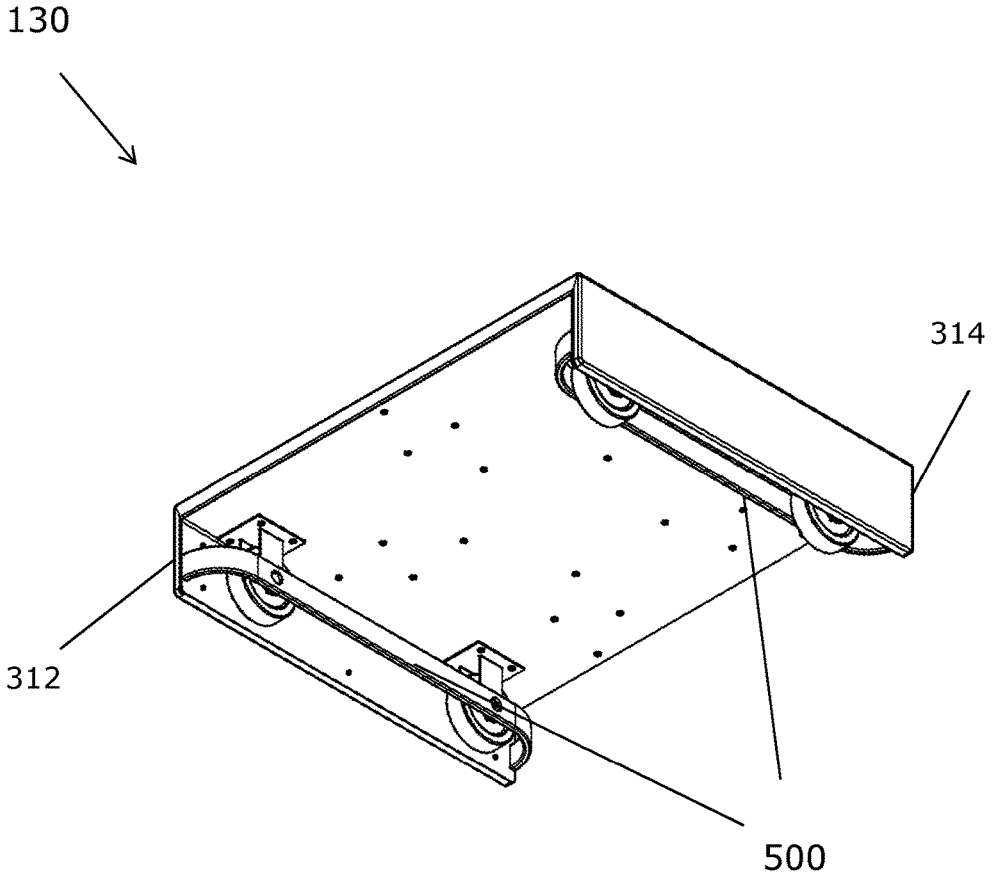

As illustrated in FIGS. 3-5, the top flat plate 200 covers a bottom plate 300 of about the same dimensions (e.g. width, length, and height) as the top flat plate 200. In alternative embodiments, the bottom plate 300 may lack side walls 310 or be slightly smaller in dimensions than the top plate 200. The bottom plate may also comprise material to support the weight of the chair 140 and the user, such as a metal steel plate. In another embodiment, the platform may comprise one plate combining the features of the top and bottom plate on its upper and under surface.

The top flat plate 200 and the bottom flat plate 300 are both rectangular or square shaped and further comprise: four aligned corners, an upper side, an underside, and two vertical opposing sides align-able with an exercise treadmill outer frame's right and left sides. The top flat plate 200 also rests directly upon the bottom flat plate 300 so that the underside of the top plate 200 is indirect contact with the bottom plate upper side.

The platform 130 further comprises a plurality of fixation mechanisms 320 for affixing the bottom plate 300 to the underside of the top plate 200. Fixation means are well known in the art, such as screws, bolts, industrial glue, etc. By way of a non-limiting examples, fixation mechanisms 320 may comprise a hollow, cylindrical wood tapping insert about 0.70-1.0 inches long fitted with a hex button head screw 0.70-1.0 inches long.

In the exemplified embodiment, the chair platform further comprises a mechanism to easily move the platform 130 on and off of the treadmill 120, such as via platform wheels 220, comprising one wheel on or near each of the four corners of a square or rectangular shaped platform. The wheels assist the user in rolling the platform over the treadmill, but other mechanisms of assisting the user to move the platform are well known in the art. For example, the opposing side walls 210 or upper side of the top plate 200 may comprise handles on the exterior surface for the user to grasp, move and lift the platform 130.

And the embodiment illustrated in FIGS. 4A and 4B, chair platform 130 comprises wheels 220 that are affixed to the bottom plate 300 via the fixation means 400 or other similar mechanisms known in the art. Fixation means 400, such as the exemplified small rectangular top plates with fixation pins, must be able to support the weight of the platform's bottom plate 300 and the top plate 200, as well as the weight of the user and the chair 140.

Platform Grooves

A wide variety of office desk chairs 140 are suitable for use with the present disclosure, including those with wheels and those without wheels. In an embodiment illustrated in FIGS. 2 and 4A, platform 130 may comprise grooves 230 or indentations in the top flat plate 200 of the platform that are shaped to fit the wheels of a variety of types of standard swivel office chairs. And, the office chair is a swivel chair with wheels, such as four or five or six wheels connected to four or five or six arms, respectively, and radially and horizontally projecting out from a central vertical axle beneath the chair. The grooves 230 are of sufficient width and length to house the chair wheels and prevent them from sliding or rolling out of the grooves, such as when the platform is moved, or the user shifts. The platform 130 may further comprise a groove 240 to snuggly fit the chair central vertical axle. By way of a non-limiting example, the grooves 230 may be oval shaped and about 5-8 inches in length (e.g. 6 inches) and 2-3 inches in width (e.g. 2.5 inches), about 1.5 inches deep, and they may or may not extend through the thickness of the top plate 200; and, the center groove 240 is cylindrical and about 2.5-3.5 inches in diameter (e.g. 3 inches) and about 1.5 inches deep. As a result of the use of the grooves 230, 240, wheeled office chairs may be safely used with the various embodiments of the present disclosure without concern for the chairs rolling off of the platform and injuring the user.

In alternative embodiments, non-wheeled or wheel-less chairs may be used that comprise, for example, two-legged chairs with substantially vertical rectangular leg members running the length of the chair (front-to-back, or side-to-side); and/or, the chair may be four-legged with four vertically mounted members with square or circular feet. In the various embodiments, the chair 140 may reside safely on the platform 130 without the user being concerned that the chair will slide off of the platform. Therefore, a platform intended solely for use with wheel-less office chairs does not necessarily require grooves carved into the platform top plate 200 to prevent the chair from rolling off of the platform. In lieu of the grooves, the platform 200 may have low ledges (e.g. about 1 to 2 inches in height) running around the perimeter of the platform top surface that stop the wheel-less chair from sliding off of the platform 200.

Platform Bumper

As illustrated in FIG. 5, the chair platform 130 may further comprise two bumper members 500 to cover the platform wheels 220 to protect against an object getting caught within the wheels. As illustrated in FIG. 4A, both side walls 310 comprise a front and back vertical edge (312, 314) on the opposing side walls 310. A corner, or junction, is created where an opposing side wall vertical edge 312, 314 is joined to the horizontal top 200 and/or bottom plate 300. A front and a back wheel 220 are in close proximity to the 312, 314 edge, wherein each wheel comprises an inner side (away from the side wall 310) and an outer side (near the side wall 310). A bumper member 500 on each side of the platform (i.e. two total per platform) may be attached to the platform 130 extending from or near to the opposing side wall front edge 312 to the back edge 314 and around the inner side of the front and back wheel.

By way of a non-limiting example illustrated in FIG. 5, each bumper member 500 may comprise a substantially rectangular straight bar with curved ends that attach to the front and back edges 312, 314 of the side walls 310 of the platform 130.

And in another embodiment, the bottom plate does not comprise opposing side walls 310, and the bumper members 500 are instead attached to the top plate opposing side walls 210 inner surface.

Although the present disclosure has been fully described by way of example with reference to the accompanied figures-drawings, it is to be understood that various changes and modifications will be apparent to those of ordinary skill in the art. Therefore, unless such changes and modifications depart from the scope of the present disclosure, then they should be construed as being included within the various embodiments.

What is claimed is:

1. An exercise treadmill chair platform system comprising a. a platform for holding a swivel chair with wheels comprising i. a top plate having a top side and an underside;

ii. a bottom plate having a top side and an underside, wherein said bottom plate is configured to span a traditional treadmill;

iii. wherein said top side of said bottom plate is connected to said underside of said bottom plate;

iv. wherein said platform has a forward facing side, a rear facing side, a right facing side, and a left facing side;

v. one or more wheels attached to said underside of said bottom plate;

vi. wherein said top side of said top plate comprises 1. a circular groove disposed in a center point of said top side;
2. a plurality of oval shaped grooves disposed radially around said circular groove, wherein said oval shaped groves are configured to hold the wheels of the chair, wherein each of said oval shaped grooves has a first end and a second end, wherein said first end of each of said oval shaped grooves is disposed towards said circular groove and said second end of each of said oval shaped grooves is disposed toward an outer edge of said platform;
3. wherein said circular groove extends through at least a portion of a depth of said top plate; and
4. wherein each of said plurality of oval shaped grooves extend through at least a portion of a depth of said top plate.

2. The platform system as in claim 1 wherein said circular groove extends through the entire depth of said top plate and wherein each of said oval shaped grooves extend through the entire depth of said top plate.

3. The platform system as in claim 1 wherein said one or more wheels further comprise four wheels;

a. wherein each of said four wheels are attached in a fixed orientation on said bottom side of said bottom plate; and b. wherein an axis of each wheel is disposed substantially perpendicular to said front facing side and said rear facing side.

4. The platform system as in claim 1 a. wherein said top plate further comprises a right side wall disposed on said right facing side and a left side wall disposed on said left facing side; and b. wherein said bottom plate further comprises a right side wall disposed on said right facing side and a left side wall disposed on said left facing side.

5. The platform system as in claim 1 further comprising a. an elongated rectangular left bumper disposed on an inner side of wheels disposed on said left facing side, wherein said elongated rectangular left bumper has a first end disposed on said forward facing side and a second end disposed on said rear facing side; and b. an elongated rectangular right bumper disposed on an inner side of wheels disposed on said right facing side, wherein said elongated rectangular right bumper has a first end disposed on said forward facing side and a second end disposed on said rear facing side.

6. The platform system as in claim 5 a. wherein said first end of said elongated rectangular left bumper is curved from said inner side of said wheels to an outer edge of said left side wall;

b. wherein said second end of said elongated rectangular left bumper is curved from said inner side of said wheels to an outer edge of said left side wall;

c. wherein said first end of said elongated rectangular right bumper is curved from said inner side of said wheels to an outer edge of said right side wall; and d. wherein said second end of said elongated rectangular right bumper is curved from said inner side of said wheels to an outer edge of said right side wall.

7. The platform system as in claim 1 wherein said plurality of oval shaped grooves further comprise four grooves spaced equidistantly around said circular groove.

8. The platform system as in claim 1 wherein said plurality of oval shaped grooves further comprise five grooves spaced equidistantly around said circular groove.

9. The platform system as in claim 1 wherein said plurality of oval shaped grooves further comprise six grooves spaced equidistantly around said circular groove.

10. The platform system as in claim 1 further comprising a. a chair disposed on said top side of said top plate, wherein said chair further comprises a plurality of wheels, wherein said plurality of wheels of said chair are respectively disposed within an oval shaped groove on said top side of said top plate of said platform;

b. a treadmill disposed under said bottom side of said bottom plate; and c. a desk disposed on a forward facing side of said platform.

11. The platform system as in claim 4 further comprising a. an elongated rectangular left bumper disposed on an inner side of wheels disposed on said left facing side, wherein said elongated rectangular left bumper has a first end disposed on said forward facing side and a second end disposed on said rear facing side; and b. an elongated rectangular right bumper disposed on an inner side of wheels disposed on said right facing side, wherein said elongated rectangular right bumper has a first end disposed on said forward facing side and a second end disposed on said rear facing side.

12. The platform system as in claim 11 a. wherein said first end of said elongated rectangular left bumper is curved from said inner side of said wheels to an outer edge of said left side wall;

b. wherein said second end of said elongated rectangular left bumper is curved from said inner side of said wheels to an outer edge of said left side wall;

c. wherein said first end of said elongated rectangular right bumper is curved from said inner side of said wheels to an outer edge of said right side wall; and d. wherein said second end of said elongated rectangular right bumper is curved from said inner side of said wheels to an outer edge of said right side wall.

13. The platform system as in claim 12 wherein said one or more wheels further comprise four wheels;

a. wherein each of said four wheels are attached in a fixed orientation on said bottom side of said bottom plate; and b. wherein an axis of each wheel is disposed substantially perpendicular to said front facing side and said rear facing side.

14. The platform system as in claim 13 wherein said circular groove extends through the entire depth of said top plate and wherein each of said oval shaped grooves extend through the entire depth of said top plate.

15. The platform system as in claim 14 wherein said plurality of oval shaped grooves further comprise four grooves spaced equidistantly around said circular groove.

16. The platform system as in claim 14 wherein said plurality of oval shaped grooves further comprise five grooves spaced equidistantly around said circular groove.

17. The platform system as in claim 14 wherein said plurality of oval shaped grooves further comprise six grooves spaced equidistantly around said circular groove.

18. The platform system as in claim 11 further comprising a. a chair disposed on said top side of said top plate, wherein said chair further comprises a plurality of wheels, wherein said plurality of wheels of said chair are respectively disposed within an oval shaped groove on said top side of said top plate of said platform;

b. a treadmill disposed under said bottom side of said bottom plate; and c. a desk disposed on a forward facing side of said platform.

19. The platform system as in claim 14 further comprising a. a chair disposed on said top side of said top plate, wherein said chair further comprises a plurality of wheels, wherein said plurality of wheels of said chair are respectively disposed within an oval shaped groove on said top side of said top plate of said platform;

b. a treadmill disposed under said bottom side of said bottom plate; and c. a desk disposed on a forward facing side of said platform.

20. The platform system as in claim 16 further comprising a. a chair disposed on said top side of said top plate, wherein said chair further comprises a plurality of wheels, wherein said plurality of wheels of said chair are respectively disposed within an oval shaped groove on said top side of said top plate of said platform;

b. a treadmill disposed under said bottom side of said bottom plate; and c. a desk disposed on a forward facing side of said platform.

* * * * *